358-140 SR
12/23/86 XR 4,631,692

United States Patent [19]

Broedner

[11] Patent Number: 4,631,692

[45] Date of Patent: Dec. 23, 1986

[54] RGB INTERFACE

[75] Inventor: Walter F. Broedner, San Jose, Calif.

[73] Assignee: Video-7 Incorporated, Milpitas, Calif.

[21] Appl. No.: 653,491

[22] Filed: Sep. 21, 1984

[51] Int. Cl.[4] ..... G06F 15/626; G09G 3/02; G09G 1/28; H04N 1/46

[52] U.S. Cl. ..... 364/518; 340/701; 340/706; 358/81; 358/140

[58] Field of Search ..... 364/518, 521; 340/701, 340/703, 706, 717, 721, 745; 358/11, 81, 82, 140, 142

[56] References Cited

U.S. PATENT DOCUMENTS

| | | | |
|---|---|---|---|
| 3,624,634 | 11/1971 | Clark | 340/324 |
| 3,641,558 | 2/1972 | Cook et al. | 340/717 |
| 3,723,652 | 3/1973 | Alles et al. | 84/464 |
| 4,121,283 | 10/1978 | Walker | 364/200 |
| 4,136,359 | 1/1979 | Wozniak | 358/17 |
| 4,142,180 | 2/1979 | Burson | 340/709 |
| 4,149,152 | 4/1979 | Russo | 340/703 |
| 4,149,184 | 4/1979 | Giddings et al. | 358/81 |
| 4,177,462 | 12/1979 | Chung | 340/703 |
| 4,183,046 | 1/1980 | Dalke et al. | 358/22 |
| 4,200,867 | 4/1980 | Hill | 340/703 |
| 4,217,604 | 8/1980 | Wozniak | 358/16 |
| 4,232,311 | 11/1980 | Agneta | 340/703 |
| 4,297,693 | 10/1981 | Parsons | 340/744 |
| 4,342,029 | 7/1982 | Hofmanis et al. | 340/721 |
| 4,425,581 | 1/1984 | Schweppe et al. | 364/521 |
| 4,437,092 | 3/1984 | Dean et al. | 340/703 |
| 4,439,760 | 3/1984 | Fleming | 340/799 |
| 4,454,593 | 6/1984 | Fleming et al. | 364/900 |
| 4,481,529 | 11/1984 | Kerling | 358/30 |
| 4,481,594 | 11/1984 | Staggs et al. | 364/521 |
| 4,498,098 | 3/1985 | Stell | 358/22 |
| 4,537,515 | 8/1985 | Dinger et al. | 368/202 |

FOREIGN PATENT DOCUMENTS

WO83/02509 7/1983 World Int. Prop. O. .

OTHER PUBLICATIONS

Gidding, G. M. et al., "Achieving a Colored Image Display from Images Lacking Specified Color Content", *IBM Technical Disclosure Bulletin*, vol. 18, No. 7, pp. 2300–2301, Dec. 1975.

Kurtz, R. C., "Dual-Port Color Monitor Adapter", *IBM Technical Disclosure Bulletin*, vol. 25, No. 3A, Aug. 1982, pp. 1331–1332.

Kurtz, R. C., "Output Latching of Color and Video Signals for a Color Monitor Adapter", *IBM Technical Disclosure Bulletin*, vol. 25, No. 3A, Aug. 1982, pp. 1333–1334.

Goozé, M. et al., "Converting Digital Data into Color Television Graphics", *Electronics*, Jan. 18, 1979, pp. 124–128.

*Primary Examiner*—Errol A. Krass
*Assistant Examiner*—Joseph L. Dixon
*Attorney, Agent, or Firm*—C. Michael Zimmerman

[57] ABSTRACT

An interface for adapting an Apple TM II series computer, having only a video output suitable for driving an NTSC-type monitor to drive an RGB-type monitor. In the preferred embodiment, the interface subdivides the computer's double-density high resolution (HIRES) video mode output having 560 transitions/monitor scan line into any of four (4) video modes for display on the RGB monitor. The interface can be provided on a card incorporated into the computer or as a unit separate and distinct from the computer and connected therewith via a cable.

6 Claims, 2 Drawing Figures

RGB INTERFACE

BACKGROUND OF THE INVENTION

This invention relates in general to computers and associated displays. More specifically, the invention is directed to an interface for adapting a computer, designed to drive an NTSC-type monitor, to drive an RGB-type monitor.

Many computers, such as for example the Apple II E TM and the Apple II C TM (trademarks of Apple Computer, Inc., Cupertino, Calif.) provide composite or National Television System Committee (NTSC) video as their only video output for driving a monitor. This invention describes an arrangement whereby 100% compatibility is achieved when translating the composite video stream of the double density high resolution (HIRES) video mode of the Apple II TM series computers into a format suitable for driving an RGB-type monitor.

Computers until today have all interfaced to monitors which are designed for the NTSC standard. The reason for this has been economics. All television sets and television studio monitors must adhere to NTSC rules to guarantee compatibility among the transmitting stations and the many different brands of receivers on the market. The volume of NTSC type monitors produced on a daily basis has made them inexpensive for use as computer monitors. Their resolution (video fidelity), however, is unnecessarily limited by a set of air communication restrictions which really do not apply to computers.

Since computers today represent an increasing market force of their own, i.e., extremely high volumes, a new type of monitor, namely the RGB, has appeared in the marketplace at comparable pricing. RGB monitors are not constrained by air communication standards (since they are intended to be used with a single transmitter, i.e. the computer) and thus have much better resolution.

Composite video is regulated by a set of codes which were formulated for television transmission and reception by the National Television System Committee (NTSC). This standarization was required so that all television transmitters and receivers (televisions) would be compatible within the United States.

NTSC monitors are also known as "composite" video monitors, which stems from the regulations imposed by the NTSC. The regulations specify that the video stream must be composed of the superimposition of four separate signals merged into one. The four signals that make up the "composite" video signal are: (1) a composite synchronization signal, (2) a composite blanking signal, (3) a color burst signal, and (4) the actual video data.

The composite synchronization signal includes both vertical and horizontal synchronizations signals. This signal is needed by the television receiver to maintain picture stability with the transmitter as the video is scanned and "painted" on the screen.

The composite blanking signal includes both vertical and horizontal blanking signals. This signal is needed to blank the video gun while its in the retrace mode. A TV picture is painted on the screen line by line starting at the top left corner of the screen. The gun is turned on whenever it is appropriate to illuminate a portion of that line. Once the line has been finished, however, the gun must be positioned on the next line down. This repositioning (retrace) of the gun from the right hand side of the screen to the left hand side of the screen must be performed with the gun off. The blanking signal guarantees that the gun is off during the repositioning of the gun.

The video data is the visual information that is transmitted by the television station and which is to be displayed to the viewer. This video information modulates the video gun as it scans across the screen in a horizontal direction for each line of the picture. The gun either illuminates the screen or not depending on the video data transmitted. Once a horizontal line has been painted the gun is "blanked" and is forced to retrace to the next lower line. Once all lines for a particular frame have been scanned the gun must again be "blanked" as it retraces to the top leftmost part of the screen, before it may "paint" the next frame. Video data has two qualities: luminance and chrominance. Luminance (brightness) is directly proportional to the voltage level (magnitude) of the video signal. Chrominance (color) on the other hand is encoded using phase shift modulation techniques.

The color burst signal is transmitted during a small portion of each horizontal line while the gun is being "blanked". The color burst signal in the United States is standarized to 3.58 MHz. An internal oscillator in the television receiver locks to the exact phase of the color burst signal. The video data's phase shift differential to this internal oscillator is then obtained, and used to control the strength of the red, green and blue guns to generate a myriad of colors.

In RGB (red green blue) monitors three color guns are directly controlled, i.e. three separate signals must be supplied. Since direct control of the color guns is available, a color burst signal is not needed and all the color decoding circuitry found in composite monitors need not be present in RGB monitors. In the RGB system there is no need to encode and decode the color information, but rather it is controlled directly, a tremendous improvement in the video bandwidth is thus obtained.

For RGB monitors, the composite blanking signal is still needed and must be supplied to all three guns. The composite synchronization signal is also needed and, depending on the monitor, is either presented as a separate input or in composite form with one of the color gun inputs.

Two types of RGB monitors are presently available: analog and digital. Some monitor manufacturers include both options in one monitor. Analog monitors have only three inputs to control the three color guns. Since their input is analog, any gun may be controlled in a continuous fashion and thus an infinite number of colors may be displayed.

Digital monitors usually have four inputs to control the three color guns. These four inputs are digital and thus only sixteen possible colors may be obtained. The possible sixteen colors are "programmed" by the RGB monitor manufacturer. Some manufacturers today supply two different sets of sixteen colors selectable via an external switch. These two different sets of sixteen colors are targeted to support the color schemes of the Apple and IBM computers.

The Apple II TM series computers generate a video mode, known as double density high-resolution (HIRES), which may have as many as 560 different transitions during a single horizontal scan line of a frame. A complete screen (frame) consists of 192 such lines.

When the double density HIRES computer video mode is displayed by a monochrome (luminance only) NTSC monitor, the resolution is 560×192. This means that the brightness of 560×192 different locations (pixels) on the screen may be independently controlled. When such a video mode is displayed on a color (luminance and chrominance) NTSC monitor, however, the 560 transitions are interpreted (in sets of four) as color information by decoding by comparison with the color burst signal. The resolution is thus 140×192 with sixteen possible colors (only color-no luminance). As can be seen, therefore, the same video mode from the computer (double density HIRES) may be interpreted in two completely different ways by the monitor depending on the type of NTSC monitor used.

SUMMARY OF THE INVENTION

Since RGB is a color medium only, two different counterpart monitor video modes must be generated to maintain compatibility, i.e. to provide either optimum-monochrome or color. This suggests that a binary switch be included in the RGB hardware to instruct it to generate either of two DIFFERENT video modes, i.e., interpret the NTSC video information from the computer in one of two different ways: the monochrome and the sixteen color equivalents.

Since most RGB monitors support at least sixteen colors the 140×192 does not represent a problem in translating. Monochrome may be thought of as a subset of two possible colors from a palette of sixteen and thus is also easily translated.

In Apple TM computers, even though the internal data bus is eight bits wide, only seven (the least significant) of these bits are used as video data. Eighty sets of these seven bits get displayed in a horizontal line to generate the possible 560 transitions of the double density HIRES video mode. This suggests Approach #1 of the present invention as follows:

Approach #1: Use the state of the unused video bus bit to control whether the next seven bits are to be interpreted as 7 pixels of the 560 mode or as one and three quarters pixels of the 140 mode. This new video mode, the "MIX" mode, is then the true representation in RGB of the NTSC equivalent of the double density HIRES video mode.

Present software (already on the market) does not know about the proposed use of the above unused bit, and believing it to be useless, leaves it in a random state. Therefore, to maintain compatibility with existing software, the following Approach #2 of the present invention:

Approach #2: Generate two binary switches (F1 and F2) that will allow for the selection of any of the 140×192 mode, 560×192 mode or the mix mode.

Approach #2 would then allow for the generation of separate 140 and 560 modes which are completely independent of the setting of the most significant video bit and thus assure compatibility with existing software.

Since two binary switches allow for four different states and only three are being used in Approach #1 and #2, then generate a fourth video mode of the RGB interface as in Approach #3:

Approach #3: Group the video data in sets of eight bits instead of in sets of seven bits to thus generate a 160×192 mode in sixteen colors.

The status of switches F1 and F2 would then select among the video modes as follows:

| F2 | F1 | Video Mode |
|---|---|---|
| 0 | 0 | 140X192 |
| 0 | 1 | 160X192 |
| 1 | 0 | MIX |
| 1 | 1 | 560X192 |

The problem with generating two new switches in any computer which has already close to 2,000,000 units out in the field is that any one of the many pieces of software available may inadvertantly change the state of the new switches. This, would of course, change the way the video information is being interpreted and thus would render the display useless. Therefore the present invention utilizes approach #4 which constitutes the presently preferred embodiment of the invention.

Approach #4: Generate the two binary switches, F1 and F2, in such a manner that it is virtually impossible for existing software to accidentally change their state.

This foolproof approach is carried out using a two-bit shift register arrangement as binary switch means for establishing switch F1 and F2 in response to two internal computer flags, in the case of the Apple II TM series computers, these flags are known as "AN3" and "$\overline{80COL}$". Based on the status of F1 and F2 any of four (4) possible RGB video modes are generated for displaying the computer-produced video data.

In essence, the present invention provides a multimode video interface for use with a computer having an internal video bus, a serial NTSC video output and first and second internal flags, for driving an RGB-type monitor, comprising:

binary switch means, responsive to the states of said first and second flags, for generating first and second binary switches F1 and F2 for subdividing a video mode of said computer into four distinct new video modes;

RGB conversion circuit means, responsive to said F1 and F2 switches, for receiving video data from said internal video bus and said NTSC serial video output, and translating the NTSC into video data a form suitable for use by an RGB monitor; and means for controlling the states of said first and second flags to select one of said new video modes.

DETAILED DESCRIPTION OF THE PREFERRED EMBODIMENT

Figure 1:
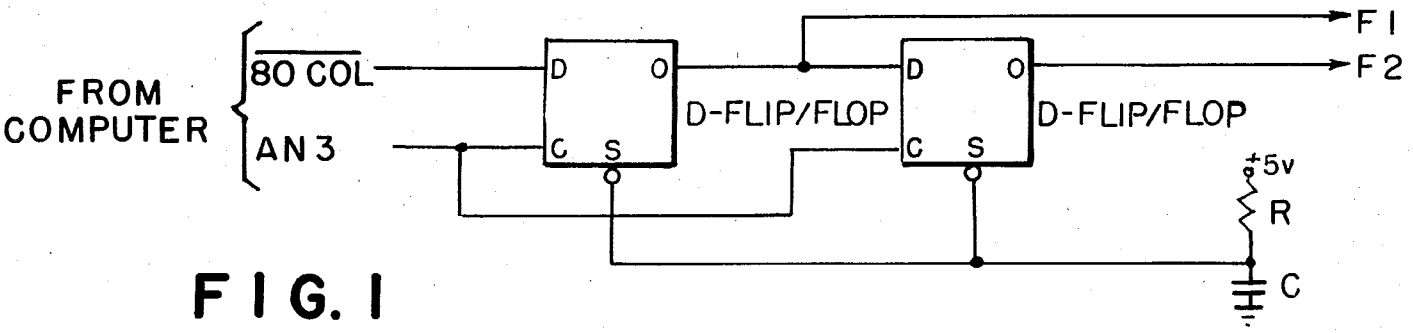
FIG. 1 is a schematic diagram of the presently preferred embodiement of an arrangement for generating binary switches F1 and F2 in response to two flags ($\overline{80COL}$ and AN3) provided by the computer.

Referring to FIG. 1, there is shown a schematic diagram of the presently preferred hardware arrangement for generating switches F1 and F2. This figure is intended to be a non-limiting example of the present invention. The concept of using switches such as F1 and F2 could be implemented in other ways.

the Apple II TM series computers use first and second binary flags known as "$\overline{80COL}$" and "AN3", respectively to select between the different video modes that the computer is able to output. The invention uses these binary flags to generate switches F1 and F2. In the computer's double density HIRES video mode, the state of the two computer flags is as follows: "$\overline{80COL}$" must be "off" and "AN3" must be "off".

Since "$\overline{80COL}$" and "AN3" must be at certain states to guarantee that the computer is in the proper video mode, it is safe to assume that, once they are set by existing software to that state, they will not be changed. Therefore, the two binary switches, F1 and F2, can be generated by sampling the history of "80COL" and "AN3".

FIG. 1 shows the presently preferred arrangement for generating F1 and F2 using a two bit shift register which uses "AN3" as its clock and "$\overline{80COL}$38 as its data input. The two bit shift register arrangement is given only as one example of the many different ways the principals of the present invention may be implemented.

The state of flag AN3 must be changed in order to "clock-in" the state of flag $\overline{80COL}$ into the shift register. Since in Apple computers only the inverse $\overline{80COL}$ of the $\overline{80COL}$ flag is available for hardware to use, the input polarity to the shift register is inverted. The shift register is set upon power-on such that the states of switches F1 and F2 get initialized to their "on" state. This is accomplished by the set input of the shift register being tied to a power-on circuit (the resistor-capacitor combination). This initialization procedure powers-on the hardware in the 560×192 mode. Optionally, the power-on state could very well have been any of the other three remaining video modes.

To select among video modes, computer software MUST now go through a very unique sequence of states before the final states of switches F1 and F2 are asserted. That is, the binary switch means isolates the RGB conversion circuitry from all changes in the states of the flags which do not follow the predetermined sequence identified below. Table I gives the sequence necessary to obtain each of the different video modes. Note that there exists a polarity difference with respect to the "$\overline{80COL}$" flag and that the final state for each sequence is always with flag $\overline{80COL}$ "on" and flag AN3 "off".

TABLE I

| 140X192 | 160X192 | MIX | 560X192 |
|---|---|---|---|
| SET 80COL | SET 80COL | CLEAR 80COL | CLEAR 80COL |
| CLEAR AN3 | CLEAR AN3 | CLEAR AN3 | CLEAR AN3 |
| SET AN3 | SET AN3 | SET AN3 | SET AN3 |
| CLEAR AN3 | CLEAR 80COL | SET 80COL | CLEAR AN3 |
| SET AN3 | CLEAR AN3 | CLEAR AN3 | SET AN3 |
| CLEAR AN3 | SET AN3 | SET AN3 | CLEAR AN3 |
| | CLEAR AN3 | CLEAR AN3 | SET 80COL |
| | SET 80COL | | |

The important concept in the above sequences is that flag "AN3" must change state from a "clear" to a "set" for every state of flag "$\overline{80COL}$" that is desired to be shifted into the shift register. Therefore the following two sequences will both shift a logic "0" into switch F1:

| | |
|---|---|
| SET 80COL | CLEAR AN3 |
| CLEAR AN3 | SET 80COL |
| SET AN3 | SET AN3 |

To set "AN3" a microprocessor access to $C05E (a hexadecimal address code of the Apple TM computer) must be performed, and to clear "AN3" a microprocessor access to $C00C (a hexadecimal address of the Apple TM computer) must be performed.

To set "$\overline{80COL}$" a microprocessor right to $COOD (a hexadecimal address code of the Apple TM computer) must be performed, and to clear "$\overline{80COL}$" a microprocess right to $COOC (a hexadecimal address code of the Apple TM computer) must be performed.

The clear and set instructions are carried out by software, preferably stored on a disk. A specific program is not set forth herein because it would be a routine matter for an ordinarily skilled computer programmer to write a routine for carrying out the steps of TABLE 1.

Figure 2:
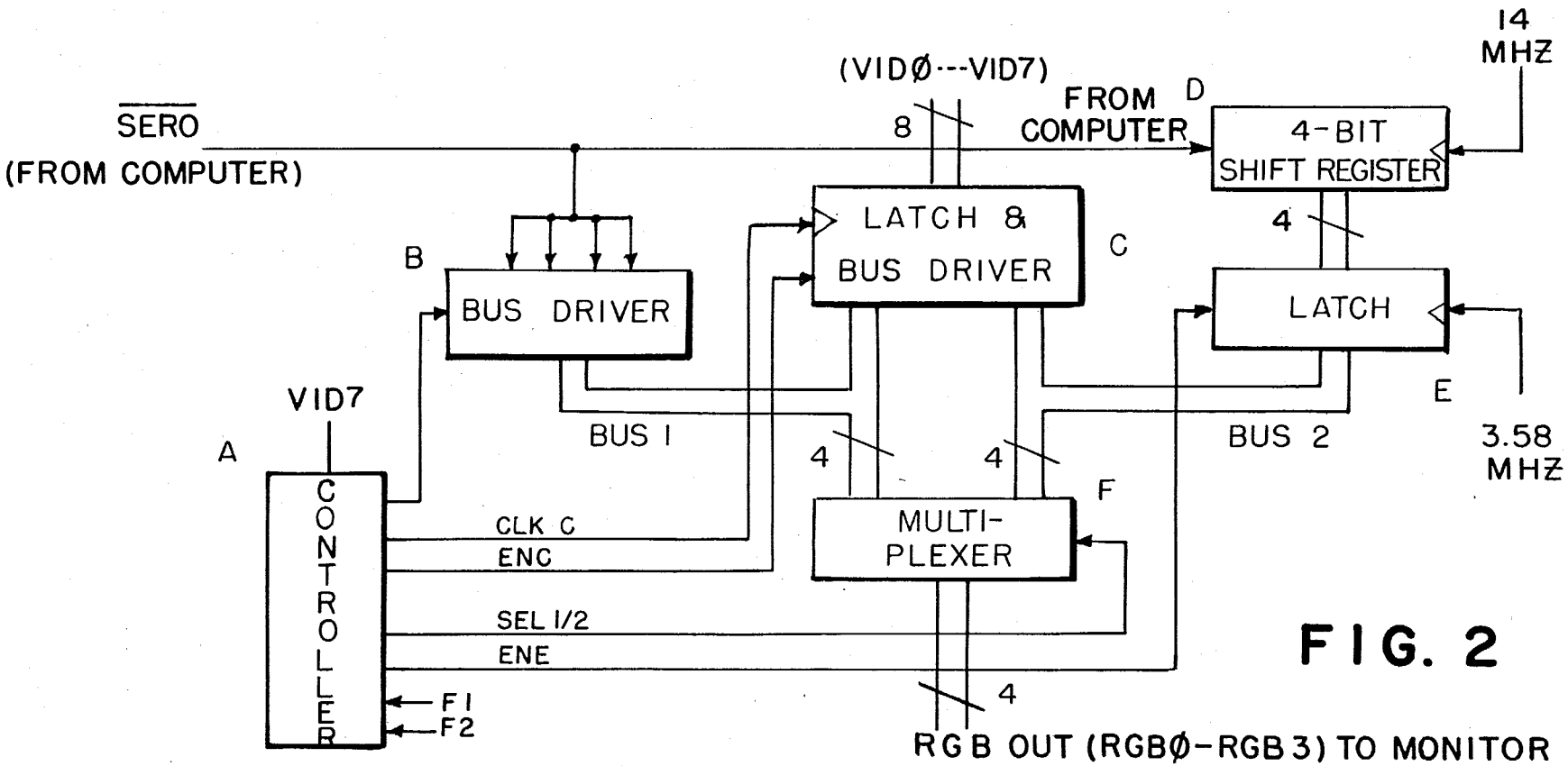
FIG. 2 is a block diagram of those portions of the RGB interface that generate four (4) different RGB video modes.

Referring now to FIG. 2, there is shown a block diagram of the presently preferred arrangement to translate the computer's composite video into the four RGB signals required by RGB monitors. This block diagram is intended only as an example of the many different ways that this invention could be implemented.

The inputs to the RGB interface from the computer (in this case the Apple II TM) are:

1. 14 MHz: This signal is the pixel clock rate. It is generated by the Apple II TM computer using a crystal oscillator. One of its periods determines the pixel duration.
2. 3.58 MHz: This signal is a divide by four of the pixel clock rate and represents the color burst signal required by NTSC rules. One of its periods contains four 14 MHz pixels.
3. VIDEO BUS: The video bus consists of eight lines and carries video data prior to its being serialized by the Apple II TM computer. Only the least significant seven lines are actually serialized into a serial video data stream. The most significant bit is ignored.
4. $\overline{SERO}$: This signal is the inverted NTSC serial video output of the Apple II TM.
5. VID7: Most significant bit of the video bus.

Block "A" (preferably constituted by a PAL 16L8 integrated circuit) constitutes controller circuitry for steering the video data through the different levels of the RGB conversion logic, until it finally becomes the four outputs RGB0 through RGB3. It samples the state of the Apple II TM video and the state of the RGB binary switches to determine which of the following RGB interface video modes it is controlling.

THE 560×192 VIDEO MODE

Block "B" (preferably constituted by a LS258 integrated circuit) is a bus driver which, under the control of block "A", is enabled into BUS1. The controller (block "A") controls block "C" (preferably constituted by a LS374 integrated circuit), which is at this time disabled from driving bus 1, to prevent a bus conflict between Blocks "B" and "C".

Block "B" is used to generate the 560×192 video mode. Controller "A" enables block "B" which then transfers the serial stream ($\overline{SERO}$) into the four lines of BUS1. When the serial stream is "on" all four lines of BUS1 will also be "on". The opposite state also applies i.e. "off" on the serial stream signifies all four BUS1 signals will be "off".

The controller then instructs block "F" which is a quad two bit multiplexer (preferably constituted by a LS399 integrated circuit) to transfer BUS1 to the RGB0 through RGB3 (RGB) output BUS. Since the RGB output BUS is now all "ones" or all "zeroes" depending whether the video stream is either "on" or "off" respectively, only two colors (black and white) out of the possible sixteen have been selected.

THE 160×192 VIDEO MODE

Block "C" includes a latch followed by a bus driver. The latch samples the video bus under control from Block "A" and holds it for seven 14 MHz pixels. Block "A" then disables Block "B" and Block "E" (preferably constituted by a LS173 integrated circuit) and enables block "C" into BUS1 and BUS2. Controller "A" then instructs multiplexer "F" to transfer BUS1 and BUS2 to the RGB output BUS. This transfer must occur twice during the seven 14 MHz pixel duration. On the first transfer the RGB output BUS becomes BUS1 and on the second transfer it becomes BUS2 (note that the reverse order may also be selected). Since 80 such periods exist in a horizontal line and two transfers have occurred in each period a total of 160 different four bit codes (representing sixteen possible colors) will have been outputted through the RGB output BUS.

THE 140×192 VIDEO MODE

Block "D" is a four bit shift register (preferably constituted by a LS173 integrated circuit) which is clocked by the 14 MHz signal and samples the serial out data of the computer. This shift register converts the serial stream into a four bit parallel stream. The latch "E" then samples and holds this four bit parallel stream every four 14 MHz periods or on a 3.58 MHz clock. These two blocks, therefore convert every four adjacent serial video bits into four parallel bits which under control from block "A" get then transferred to the RGB output BUS. Block "A" disables Blocks "B" and "C" and enables Block "E" into BUS2 and also instructs Block "F" to transfer BUS2 into the RGB output BUS. Since there exists 80 seven bit periods in a horizontal line or a total of 560 such periods, and they have been grouped into groups of four, a total of 140 four bit codes will have been outputted in one such line.

THE MIX MODE

Since the logic block of FIG. 2 can generate both the 560×192 and the 140×192 video modes then it can also mix them anywhere on the screen during a single frame of display. This is accomplished by controller "A" sampling the most significant bit of the video bus (VID7) and either enabling the 560 (Block "B") path OR the 140 path (Block "E") for the duration of the next seven 14 MHz periods. This is accomplished by enabling blocks "B" and "E" into BUS1 and BUS2, respectively, disabling Block "C", and instructing Block "F" to either transfer BUS1 or BUS2 into the RGB output BUS depending on the state of the most significant bit of the video bus.

In summary, the present invention provides an arrangement for emulating an NTSC monitor in an RGB monitor while permitting to new and useful video display modes to be created.

Other embodiments and modifications of the present invention will be apparent to those of ordinary skill in the art having the benefit of the teaching presented in the foregoing description and drawings. It is therefore, to be understood that this invention is not to be unduly limited and such modifications are intended to be included within the scope of the appended claims.

What is claimed is:

1. A multi-mode video interface for use in adapting an Apple TM II-series computer having an NTSC-type video output for driving an RGB-type monitor, comprising:

means for receiving first and second video mode controlling flags from said computer;

means for receiving serial video data from said computer;

means for receiving parallel video bus data from said computer;

an RGB output bus for driving said RGB-type monitor;

means for receiving a clock signal from said computer;

binary switch means, responsive to said first and second flags, for generating first and second binary switches F1 and F2 for controlling an output video mode of said interface;

means for controlling the states of said first and second flags to select a video mode; and RGB conversion circuit means for providing, in response to said clock signal, flags, parallel video data and serial video data RGB video data on said RGB output bus, said circuit comprising:

a controller, responsive to said binary switches F1 and F2 for steering video data;

a bus driver, under the control of said controller for receiving said serial video data and placing it on a first four bit bus;

a shift register circuit, having a data input for receiving said serial data and a clock input for receiving said clock signal, for outputting serial data onto a shift register output bus;

a first latch having an input coupled to said shift register output bus for latching data therefrom onto a second bus;

a second latch and bus driver having an input video bus receiving said parallel data and first and second outputs coupled to said first and second buses respectively; and a multiplexer for providing said RGB video data to said RGB bus.

2. A multi-mode video interface for use with a computer having a video bus which presents video information in a parallel form and has a serial video output, comprising:

RGB conversion circuit means for receiving video data from both said video bus and said serial video output, and generating video data on an RGB output bus in a form suitable for use by an RGB monitor in one video mode of multiple possible video modes; and means for selecting at least two of said modes during a single frame of video display to present both of said modes at different positions in said frame of said display said means for selecting including binary switch means for generating first and second binary switches F1 and F2 for controlling a video mode of said interface wherein each byte of information provided at said video output includes an information bit which is not used to provide said video information and a controller is provided responsive to the state of said bit by designating specific ones of said multiple possible video modes.

3. An interface according to claim 2 wherein said controller is adapted to be responsive to the state of said bit only when said RGB conversion circuit means is providing at least two different modes during a single display frame.

4. A multi-mode video interface for use in adapting a computer normally operable with an NTSC-type monitor for operating an RGB-type monitor, which computer includes first and second internal flags and has both a video bus which presents video information in a parallel form and a serial video output, comprising:

binary switch means responsive to the states of said first and second flags for generating first and second binary switches F1 and F2 for controlling a video mode of said interface;

RGB conversion circuit means responsive to said F1 and F2 switches for receiving video data from said video bus and said serial video output and generating video data on an RGB output bus in a form suitable for use by an RGB monitor in one video mode of multiple possible video modes; and said binary switch means being adapted to isolate said RGB conversion circuit means from all changes in the states of said first and second internal flags which do not follow predetermined patterns wherein said binary switch means isolates said RGB conversion circuit means from all changes in the states of said first and second internal flags unless such changes follow one of the following four patterns:

1. One of said first and second flags=set;
The other of said flags=clear;
The other of said flags=set;
The other of said flags=clear;
The other of said flags=set;
The other of said flags=clear;
2. One of said first and second flags=set;
The other of said flags=clear;
The other of said flags=set;
The first one of said first and second flags=clear;
p2 The other of said flags=clear;
The other of said flags=set;
The other of said flags=clear;
The first one of said first and second flags=set;
3. The first one of said first and second flags=clear;
The other of said flags=clear;
The other of said flags=set;
The first one of said first and second flags=set;
The other of said flags=clear;
The other of said flags=set;
The other of said flags=clear;
4. A first one of said first and second flags=clear;
The other of said flags=clear;
The other of said flags=set;
The other of said flags=clear;
The other of said flags=set;
The other of said flags=clear;
The first one of said first and second flags=set.

5. A multi-mode video interface for use with the Apple II TM -series computer for driving an RGB type monitor comprising:

binary switch means, responsive to the states of first and second internal flags (AN3 and $\overline{80COL}$) of the computer, for generating first and second binary switches F1 and F2 for subdividing the Double HIRES video mode of said computer into four distinct video modes; and RGB conversion circuit means, responsive to said F1 and F2 binary switches, for receiving video data from the computer's internal video bus and serial NTSC video output, and generating video data on an RGB bus in a form suitable for use by an RGB monitor, wherein said F1 and F2 binary switch means isolates said RGB conversion circuit means from all changes in the states of said first and second internal flags (AN3 and $\overline{80COL}$) of the computer unless such changes follows one of the following four different patterns;

(1) 560×192 Video mode: Clear $\overline{80COL}$, Clear AN3, Set AN3, Clear AN3,Set AN3, Clear AN3, Set $\overline{80COL}$.

(2) 140×192 Video mode: Set $\overline{80COL}$, Clear AN3, Set AN3, Clear AN3, Set AN3, Clear AN3.

(3) 160×192 Video mode: Set $\overline{80COL}$, Clear AN3, Set AN3, Clear $\overline{80COL}$, Clear AN3, Set AN3, Clear AN3, Set $\overline{80COL}$.

(4) MIX Video mode: Clear $\overline{80COL}$, Clear AN3, Set AN3, Set $\overline{80COL}$, Clear AN3, Set AN3, Clear AN3.

6. A multi-mode video interface for use with the Apple II TM -series computer for driving an RGB type monitor comprising:

binary switch means, responsive to the states of first and second internal flags (AN3 and $\overline{80COL}$) of the computer, for generating first and second binary switches F1 and F2 for subdividing the Double HIRES video mode of said computer into four distinct video modes; and RGB conversion circuit means, responsive to said F1 and F2 binary switches, for receiving video data from the computer's internal video bus and serial NTSC video output, and generating video data on an RGB bus in a form suitable for use by an RGB monitor, wherein said RGB conversion circuit means under control of said F1 and F2 binary switches and the most significant bit of the computer's video bus comprises means for selecting between said 560×192 and 140×192 video modes during a single frame of video display to present both of said video modes at different positions in said frame of said display.

* * * * *